US009578691B2

(12) United States Patent
Erismis et al.

(10) Patent No.: US 9,578,691 B2
(45) Date of Patent: Feb. 21, 2017

(54) HEATER, IN PARTICULAR HIGH-TEMPERATURE HEATER, AND METHOD FOR THE PRODUCTION THEREOF

(75) Inventors: Harun Erismis, Stuttgart (DE); Michael Geiss, Stuttgart (DE); Dominik Nemec, Stuttgart (DE); Frank Jördens, Traunstein (DE); Gerhard Schmidmayer, Bad Endorf (DE); Philipp Schaller, Traunreut (DE); Jürgen Salomon, Trostberg (DE)

(73) Assignees: Fraunhofer-Gesellschaft zur Förderung der angewandten Forschung e.V., Munich (DE); BSH Hausgeräte GmbH, Munich (DE)

( * ) Notice: Subject to any disclaimer, the term of this patent is extended or adjusted under 35 U.S.C. 154(b) by 963 days.

(21) Appl. No.: 13/386,477

(22) PCT Filed: Jul. 19, 2010

(86) PCT No.: PCT/EP2010/004389

§ 371 (c)(1),
(2), (4) Date: Jan. 23, 2012

(87) PCT Pub. No.: WO2011/009577

PCT Pub. Date: Jan. 27, 2011

(65) Prior Publication Data

US 2012/0118873 A1 May 17, 2012

(30) Foreign Application Priority Data

Jul. 21, 2009 (DE) ..... 10 2009 034 307

(51) Int. Cl.

| | |
|---|---|
| ***B05D 5/12*** | (2006.01) |
| ***H05B 3/74*** | (2006.01) |
| ***H05B 3/26*** | (2006.01) |

(52) U.S. Cl.
CPC ..... *H05B 3/748* (2013.01); *H05B 3/26* (2013.01); *H05B 2203/005* (2013.01);
(Continued)

(58) Field of Classification Search
USPC ..... 427/112
See application file for complete search history.

(56) References Cited

U.S. PATENT DOCUMENTS 6,379,825 B1 * 4/2002 Goelff et al. ..... 428/332
2007/0221649 A1 9/2007 Ohta
(Continued)

FOREIGN PATENT DOCUMENTS

DE 10 2004 04435 3/2006
DE 10 2007 01854 10/2008
(Continued)

OTHER PUBLICATIONS

International Search Report for corresponding International Patent Application No. PCT/EP2010/004389 dated Sep. 8, 2010 and English translation.

*Primary Examiner* — Austin Murata
(74) *Attorney, Agent, or Firm* — Renner, Otto, Boisselle and Sklar LLP

(57) ABSTRACT

The invention relates to a method for producing a heater, in particular a high-temperature heater and also a high-temperature heater, for example for domestic heating appliances, in which a layer that produces heat when a current flows through is provided on a carrier material (12) as a heating element (14), wherein a first electrically conductive layer (16) which is formed from a free-flowing, non-electrically conductive base material and carbon nano tubes dispersed therein is applied to the carrier material (12), wherein a protective layer (17) is applied to this first layer (16) and at least partly penetrates into the first layer (14) as
(Continued)

Figure 1:
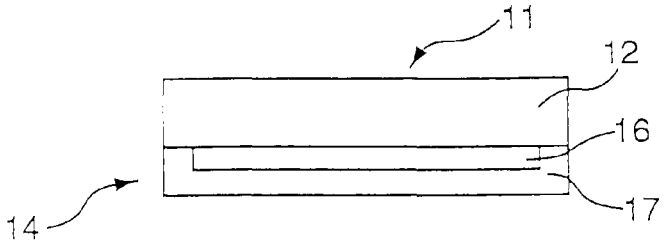

it is applied, or wherein a functional layer (21) with carbon nano tubes dispersed therein is applied to the carrier material (12), and wherein the at least one layer (16, 17) or the functional layer (21) makes contact with strip-like contact elements (18), and the layers (16, 17) applied to the carrier material or the functional layer (21) are heated.

13 Claims, 1 Drawing Sheet

(52) U.S. Cl.
CPC .. *H05B 2203/011* (2013.01); *H05B 2203/013* (2013.01); *H05B 2203/017* (2013.01); *H05B 2203/028* (2013.01); *H05B 2214/04* (2013.01); *Y10T 29/49083* (2015.01)

(56) References Cited

U.S. PATENT DOCUMENTS

| | | | | |
|---|---|---|---|---|
| 2008/0299300 | A1* | 12/2008 | Wilcoxon et al. | 427/96.1 |
| 2008/0317966 | A1* | 12/2008 | Verlotski | 427/452 |
| 2009/0324811 | A1* | 12/2009 | Jung | 427/113 |

FOREIGN PATENT DOCUMENTS

| | | |
|---|---|---|
| DE | 10 2009 00013 | 5/2009 |
| JP | 2003 109732 | 4/2003 |

* cited by examiner

HEATER, IN PARTICULAR HIGH-TEMPERATURE HEATER, AND METHOD FOR THE PRODUCTION THEREOF

The invention relates to a method for producing a heating installation, particularly a high-temperature heating installation, as well as a heating installation, particularly a high-temperature heating installation, on which a layer generating heat in an electricity flow is provided on a substrate.

Heating installations of this type, particularly high-temperature heating installations, are used for white goods products, particularly as a heating installation for a baking oven, toaster or stove or glass ceramic hob. For heating these objects up to temperatures of >400° C., heating rods have been used up to now, from which heat radiation also occurred, in order to heat up the bordering substrate. By using heating rods of this type, there is an inhomogeneous heating process. A targeted focussing on the food to be cooked or the contents to be heated is therefore not given. Furthermore, there is an air cushion between the heating wires and the substrate, which negatively impacts on the heat transfer.

In order to avoid an inhomogeneous heating process, induction hobs are known, for example, in which the heat is directly generated in the cooking pot by eddy currents. Through this, a homogeneous heating of the food to be cooked is indeed achieved, but the acquisition costs are high, and special pots are required for heating the food to be cooked. This high-temperature installation cannot be readily transferred to other white goods products.

A plate-like heating element is known from DE 10 2005 049 428 A1, which is used for room air-conditioning in homes and buildings. On a composite board, a heating layer of a plastic-fibre mixture with non-conductive materials has become known, which is applied on plasterboard or a composite board provided with a composite construction on the rear side. Strip-shaped contact elements are provided for the contacting of the heating layer, so that surface heating of the layer is made possible on the plastic-fibre mixture. Due to their arrangement of the heating layer, flat heating installations of this type only permit temperatures in a region of <50° C., and are not suitable for use in white goods. In addition, the application of fibre mixtures or fibre webs of this type is very cost-intensive.

The same applies, for example, for the flat heating elements which have become known from DE 20 2005 013 822, which are constructed in the same way as the heating element for room air-conditioning. Composite systems of this type with a paper-like fibre structure are complex and cost-intensive to produce. The adaptation to any geometries and simple application are also made more difficult.

An electric hot plate with at least one cooking zone is known from DE 100 01 330 A1, which uses glass ceramic, glass or ceramic as a substrate. On its underside, for heating of the cooking zones, an electric insulating layer is provided, as well as a thermally insulating cover layer, with a heat-resistant material being provided lying in between. The heat-resistant material consists of an electrically conductive carbon, graphite particles or carbon fibres, which are contacted with electrodes. The heat-resistant element can be mixed with a binder made of heat-resistant organic or inorganic substances. The second thermally insulating cover layer applied thereon air-tightly seals the heat-resistant element against the atmosphere, whereby the cover layer consists of heat-resistant glass or an enamel layer. The assembly of the hot plate body takes place by electrochemical bonding of the layers lying on top of one another, whereby it is intended that the heat-resistant element is brought to a temperature of over 400° C. by heating, and an electric voltage of more than 400 V is applied to the hot plate body and the heat-resistant element.

This layer structure of the cooking zone has the disadvantage that a complex presentation of the adhesion properties is given by the high voltages, and no free choice of the contacting methods is facilitated, since the contacting must be directly on the conducting layer.

Furthermore, an electric oven plate for heating is disclosed in DE 103 36 920 A1, which refers to a structure of the electric hot plate according to DE 100 01 330 A1, whereby this structure is to be used for electric baking ovens, cooking ovens or electric ovens.

The object of the invention is to suggest a method for producing a heating installation, particularly a high-temperature heating installation, as well as a heating installation, particularly a high-temperature heating installation, in which a heating element can be applied simply as a thin layer, and facilitates a homogeneous heat transfer.

According to the invention, this object is achieved by a first alternative of the method for producing the heating installation, particularly of the high-temperature heating installation, in which for producing a heating element on the substrate, a first electrically conductive layer is applied, which is formed from a flowable base material, and carbon nanotubes dispersed therein, that a protective layer is applied onto this first layer, which protective layer at least partly penetrates this by means of the application onto the first layer.

Furthermore, the object is achieved by a second alternative of the method for producing the heating installation, in which a functional layer with carbon-nanotubes dispersed therein is applied onto the substrate.

Both methods allow a very thin heating element to be produced, which can be heated very quickly, and which facilitates an even heat transfer onto the substrate. Through the heat treatment process after the application of the first layer and the protective layer or the functional layer, it has surprisingly been turned out that the carbon nanotubes selected as the conductive material can be used in a temperature-resistant manner in the first layer and the protective layer or the functional layer, and burning is avoided. Through this, a heating element is provided, which facilitates operation with temperatures of >400° C., as well as a corresponding thermal shock facility and mechanical bonding to the substrate. Due to the subsequent heat treatment or due to the heating, a compression of the layers is achieved with the first layer and the protective layer or the functional layer. This has the advantage that high-temperature heating elements are air-tightly or oxygen-tightly compressed. The temperature stability of the dispersed carbon nanotubes is therefore achieved.

According to a preferred configuration of the method, it is intended that the at least one layer or the functional layer are contacted with contact elements, and the layers or the functional layer applied on the substrate are heated. An increased mechanical bonding between the contact element and the substrate can therefore be achieved.

A further preferred configuration of the method intends that the contact elements are strip-shaped. A flat surface heating can therefore be achieved.

According to a preferred configuration of the method, it is intended that the applied first layer and protective layer or the applied functional layer are heated to a temperature particularly between 300° C. to 700° C. Due to this heat treatment, a sintering process of the layers takes place. A compression of the layers or the functional layers can take place in particular. This has the advantage that high-temperature heating installations can be compressed by a sinter process sealed against atmospheric oxygen, and are thus suitable and resistant in operation at temperatures of >400° C.

According to a further preferred configuration of the method, it is intended that the first electrically conductive layer and protective layer or the functional layers applied on the substrate are only heated by applying voltage to the strip-shaped contact elements. This configuration has the advantage that the high-temperature heating installation is heated from within. This makes it possible, for example, firstly that organic material of the first electrically conductive layer can diffuse out, or can diffuse through the already applied protective layer. The heating from within has the advantage that mechanical voltages do not develop in the first electrically conductive layer. This heating can therefore contribute to the stability of the layer. Alternatively, it is intended that the high-temperature heating installation with its substrate is only applied onto a hot plate or external heat source, so that the heat generated through this rises from bottom to top, as well as the electrically conductive layer being heated first of all and then the further protective layer. Through this, an effect analogous to the direct heating of the heating element by the contact elements can be given.

A preferred configuration of the method intends that the first layer is dried after the application, and then the protective layer is applied. This drying method has the advantage that the first layer is at least slightly compressed, as particularly water-soluble components can evaporate, before the further protective layer is applied. This favours a thinner structure of the heating installation.

According to a further preferred configuration of the method, it is intended that the first layer, and separately, the protective layer or the functional layer, are applied by a spraying method by squeegee or a printing method. For example, a screen printing method can be intended, in which the particularly pasty first layer is applied onto the substrate in an easy manner. The second protective layer can then be applied in the same way, also preferably in a pasty form. Known technologies can therefore be used for the production of high-temperature heating elements. The same applies for the application of the functional layer to the substrate. Alternatively, a spray or spraying method can be intended in order to apply the first and second layer or the functional layer onto the substrate. A so-called spray coating, a dip coating, so an immersion coating, or a spin coating can be implemented here.

A further preferred embodiment of the procedure intends that the first layer is applied over the whole area or in strips lying next to one another, the protective layer is applied over the whole area of the first layer and completely covers the substrate, whereby strip-shaped contact elements are applied before or after the application of the first layer. Therefore the first layer as the electrically conductive layer is connected to the strip-shaped contact elements, and subsequently facilitates an electrical insulation through the protective layer with the exception of connection points on the strip-shaped contact elements. Due to the complete covering of the electrically conductive layer by the protective layer, it is also made possible that for the production of the first electrically conductive layer, water-soluble materials can be used as a basis for dispersion. These again have the advantage that processing without the use of solvents is possible and presents no health risks.

A further preferred configuration of the method intends that before the application of the first layer or the functional layer onto the substrate in the heating region, an electrically insulating layer is applied onto the substrate. This takes place particularly when the substrate is not made of a dielectric material, but rather from an electrically conductive material or a weak electrically conductive material.

A preferred implementation of the method intends that for producing the first layer as an electrically non-conductive base material, an aqueous solution, particularly water or distilled water, is used, which preferably includes a dispergent, such as gum arabic, for example. This allows a simple application, particularly as a full-area layer, without using solvent for the production of dispersion, as well as for the cleaning of machinery.

A further preferred configuration of the method intends that fillers of carbon nanotubes and/or graphite are included in the electrically non-conductive base material, and this paste can then be printed. This last step describes the application of the protective layer (top coat), which preferably consists of ethyl silicate with graphite.

Preferably single, double, or multi-walled nanotubes can be used here. In particular, the combination of graphite and carbon nanotubes has the advantage that a dispersion, which is capable of flow, is achieved for the first layer for full-area application onto a substrate.

For producing the protective layer or functional layer, a silicate, particularly an ethyl silicate, is intended for forming an inorganic layer. This has the advantage that particularly after the temperature treatment by heating, the production of an inorganic layer is achieved, which is robust and airtight in use, and therefore also facilitates operation at temperatures >400° C. At the same time, this also gives thermal shock stability as well as mechanical bonding to the substrate.

According to a further preferred configuration of the method, it is intended that a filler, particularly graphite, is dispersed into the protective layer or into the functional layer. This has the advantage that particularly in the first alternative embodiment of the method for penetrating the protective layer into the first electrically conductive layer, the filler relationship is increased, which also increases the conductivity in the second layer. Therefore, the contacting can be applied flexibly at any time and in various places. The protective layer serves not only for insulation against atmospheric oxygen, by the addition of graphite, which is more temperature-stable in air than the carbon nanotubes, but also after the penetration and the resulting shift of the weight percentage proportions of the filler, a functional layer is given for effective through-contacting. This layer therefore has three characteristics overall:

1) Bonding by penetration; 2) Insulation against atmospheric oxygen; 3) conductive, carbon nanotubes free layer for through-contacting.

In the second embodiment of the method, in which the functional layer contains carbon nanotubes and/or graphite, a simple application in a process layer, such as for example in a printing process, achieves good bonding. Preferably, elements for higher voltages can also be produced.

Furthermore, it is preferably intended that an adhesive agent, particularly gum arabic, is dispersed into the first layer. Therefore, adhesion between the first layer and a substrate can be improved. The gum arabic serves as an adhesive agent before the application of the protective layer (top coat). It is therefore guaranteed that when imprinting the protective layer (top coat), this does not destroy the first layer (pre coat).

The gum arabic is burnt out during the fusion penetration of the layers. Before the protective layer develops in a gas-tight manner, the volatile components of the gum arabic disperse. Other surfactants such as SDS or triton are also possible as an alternative to gum arabic.

Furthermore, this task is also solved by a heating element, particularly a high-temperature heating element, for example, thermal household appliances, in which, on the substrate, a first electrically conductive layer consisting of a base material and a carbon nanotube dispersed therein and a protective layer are provided, which is at least partly penetrated into the first layer, and covers the first layer, or that a functional layer with carbon nanotubes dispersed therein is applied on the substrate. This particular design of the heating element makes it possible to achieve a high-temperature resistance as well as thermal shock stability. At the same time, any geometries for the heating elements on a substrate, particularly for the generation of a high-temperature heating installation, can be selected.

A preferred configuration of the heating element intends that the layers or the functional layer are contacted with contact elements. A simple connection can therefore be achieved.

The contact elements are preferably formed in a strip-shape.

A further preferred embodiment of the heating installation intends that the layers or the functional layer are compressed through temperature treatment. Through this, the temperature resistance and/or thermal shock stability can be further increased.

Furthermore, it is preferably intended that the first layer and the protective layer or the functional layer form a heating element with a layer thickness of less than 500 μm, particularly less than 100 μm. An ultra-thin application can be made possible by the selection of the materials. At the same time, a homogenous heat generation within the first electrically conductive layer and therefore of the substrate can take place.

The heating installation preferably has a first layer, which comprises a concentration of 0.1 to 100 wt % carbon nanotubes in the flowable base material, particularly in water or distilled water. Therefore a high electrical conductivity can be given, so that it can be used with lower voltages. Preferably, a concentration of 1 to 3 wt % carbon nanotube and 5 to 50 wt % graphite as fillers is provided in the base material. By adding graphite, the flow capabilities of the first layer or the mixture can be increased.

According to an alternative embodiment of the heating installation it is intended that a concentration of 0.1 to 100 wt % carbon nanotubes in the base material, which preferably consists of silicate, particularly ethyl silicate, is introduced into the functional layer. Alternatively, a matrix of a concentration of 1 to 3 wt % carbon nanotubes and 5 to 50 wt % graphite is introduced into the functional layer. Due to a mixture of this type, the functional layer can be applied by screen printing. At the same time, the air insulation as well as the stability of the carbon-nanotubes is sufficiently achieved.

The heating element preferably comprises a heating element with a first layer and a protective layer or a functional layer, which has electrical resistance of less than 100 Ohm/Sq. This permits a temperature generation of >400° C. on large substrates by means of a general voltage supply in the household. In addition, the layers can be laid out even thinner, in order to guarantee further improved mechanical stabilities.

For producing the heating installation, a substrate is preferably provided, which consists of ceramic, glass ceramic, Ceran ceramic, aluminium oxide ceramic, MgO, KER 520. Diverse fields of use, particularly in white goods, are therefore made possible. At the same time, more cost-effective production can also be achieved through this.

Figure 2:
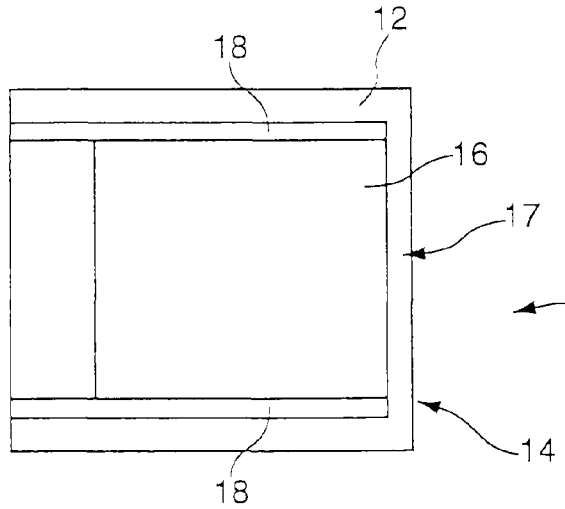
Figure 3:
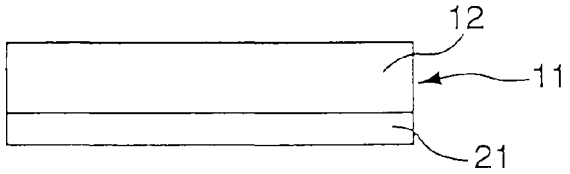
Figure 4:
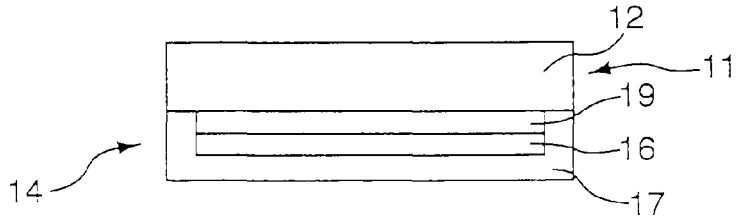
Figure 5:
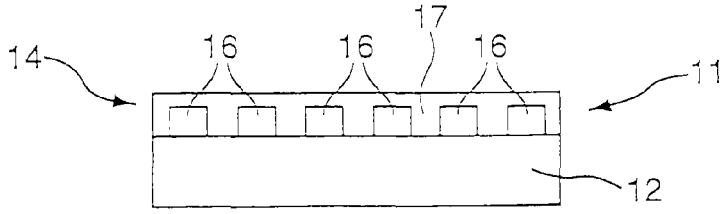

The invention as well as advantageous embodiments and further developments of the same are subsequently explained in more detail and described by means of the examples shown in the drawings. The features to be taken from the description and the drawings can be used individually or in any combination according to the invention. In the drawings:

FIG. 1 is a schematic sectional representation of a first embodiment of a heating installation, FIG. 2 is a schematic side view from below of the heating installation according to FIG. 1, FIG. 3 is a schematic side view of a heating installation alternative to FIG. 1, FIG. 4 is a schematic side view of a heating installation alternative to FIG. 1 and FIG. 5 is a schematic side view of another embodiment alternative to FIG. 1.

A schematic side view of a heating installation 11, particularly a high-temperature heating installation, is shown in FIG. 1. FIG. 2 shows a schematic view from underneath. The high-temperature heating installation 11 includes a substrate 12, which, for example, in use in the field of white goods, can be designed as ceramic, glass ceramic, Ceran ceramic, aluminium oxide ceramic or similar. On their underside, a heating element 14 is provided within a heating region. This heating element 14 includes a first electrically conductive layer 16, on which a protective layer 17 is applied. Preferably, the protective layer 17 completely covers the first electrical layer 16, so that this is provided as electrically insulated and mechanically protected against the environment on the substrate 12. The first electrically conductive layer 16 extends between two strip-shaped contact elements 18, which are guided up to an edge of the substrate 12, for example, for contacting the electrical layer 16. The first layer 16 extends between both contact elements 18, which are preferably running parallel to one another, and forms the heating region. The protective layer 17 covers the first layer 16, and preferably the strip-shaped contact elements 18, so that only in the edge region, for example, a free contacting point can be omitted. Alternatively, it can also be intended that the first layer 16 and the protective layer 17 are applied first of all, and then the strip-shaped contact elements 18 are brought through the heating region formed by the first layer 16 and protective layer 17.

The first electrically conductive layer 16 consists of a flowable, electrically non-conductive base material, which can flow. Dispersion on an aqueous basis is also preferably intended. In this dispersion, carbon-nanotubes are dispersed as electrically conductive material. In addition, the dispersion includes a filler, particularly graphite, in order to support the electrical conductivity and to set flow capability. An adhesive agent is also preferably provided in the dispersion. This can be gum arabic, for example. Other surfactants such as SDS or triton can also be used. Through this, a pasty or flowable mass can be produced, which can be applied onto the substrate 12 in a printing process or spraying process. This dispersion is resistant to high-temperatures, thermal shock and is hydrophobic. The protective layer 17 preferably consists of a silicate, which can preferably be enriched with an adhesive agent, filler or other particles, in order to increase the adhesive qualities. Through this, the thermal shock stability as well as the mechanical bonding to the substrate can be improved. Due to the protective layer 17 penetrating into the first layer 16, these carbon nanotubes are also suitable for use at temperatures above 350° C., since the protective layer 17 seals the carbon nanotubes in an airtight manner. The electrically conductive material preferably consists of a compound of carbon nanotubes and graphite or other electrically conductive particles or components, which facilitate the forming of a pasty matter or matter, which can be sprayed.

The heating element 14 shown in FIG. 1 is produced by the components of an electrical non-conductive base material and carbon nanotubes dispersed therein, or a compound of carbon nanotubes first of all being mixed with other electrically conductive materials, in order to form a pasty or flowable mass, which is applied onto the whole surface of the substrate by means of a screen printing process. Subsequently the strip-shaped contact elements 18 can be imprinted in a screen printing process, preferably by application of a conductive paste, particularly silver conductive paste. These contact elements 18 can also be provided on the substrate 12 before the application of the first layer 16. Subsequently, according to a variant of the first embodiment of the production process, this first layer 16 can be temperature-treated. This has the advantage that a hardening and drying up of the base material or the aqueous basis for the first layer 16 formed as dispersion takes place, which increases subsequent penetration of the protective layer 17. The protective layer is preferably applied by a screen printing process. Alternatively, this can also be applied without an intermediary drying process of the first layer 16. Subsequently the substrate 12 with the layers 17 applied thereon as well as the contact elements 18 are temperature-treated, so that at least the protective layer 17 is preferably sintered. Here the compression takes place and causes the conductive particles to be further 'pressed together', which leads to a lower spec. resistance due to the increased contact number and the compactness. This can also result in improving the conductivity in the first layer 16.

High-temperature heating installations 11 comprise heating elements 14, of which the thickness can be <100 μm, for example. In addition, due to the full-area arrangement of the electrically conductive layer 16 on the substrate 12, homogeneous heating and heat radiation 12 are made possible.

The protective layer 17 can preferably be assigned to a reflector, in order to reflect the heat radiation coming from the heating element 14 in the opposite direction to the substrate 12, and to accelerate the heating of the substrate 12.

An embodiment alternative to FIG. 1 is shown in FIG. 3, and to the effect that instead of successive application of the first layer 16 and the protective layer 17, a functional layer 21 is applied. This functional layer 21 is produced from the same base material as the protective layer 17. A silicate, particularly ethyl silicate, in which carbon nanotubes are dispersed, is used here. This functional layer 21 to the carbon nanotubes can preferably include other conductive particles, and particularly a binding agent, preferably graphite, as a further component. By means of a functional layer 21 of this type, it is made possible for a pasty matter to be given, which can be applied by a spraying process or a screen printing process. Furthermore, by means of the subsequent heating, a compression of this layer by a sinter process is also achieved, whereby the conductivity is increased. This alternative embodiment simplifies production of a heating element 14 of this type, whereby at the same time the requirements for operation at temperatures of >400° C. as well as mechanical bonding and thermal stability are also given. The strip-shaped contact elements 18 can be applied onto the substrate 12 before or after the application of the functional layer 21.

An embodiment alternative to FIG. 1 is shown in FIG. 4. This embodiment differs from that in FIG. 1, in that before the application of the first electrically conductive layer 16, an electrical insulating layer 19 is applied over the whole area of the substrate 12, in order to arrange the electrically conductive layer 16 in an insulated way with regard to the substrate 12. This arrangement of the insulating layer 19 can also be intended in the event of applying a mixture consisting of the first electrically conductive layer 16 and the protective layer 17. Also, before the application of the functional layer 21 onto the substrate, an electrically insulating layer 19 can be applied over the whole surface.

An embodiment alternative to FIG. 1 is shown in FIG. 5. This embodiment only differs in that instead of a full-area first electrically conductive layer 16, a strip-shaped layer 16 is formed. Bars or ribs can be adapted in geometry and contour to the corresponding cases of use. The strip geometry can heat specific areas. In addition, it favours the bonding qualities on the respective substrate. The strips can be arranged in any way, so that on a substrate, specifically different heating zones can be implemented.

The invention claimed is:

1. A method for producing a heating installation in which an electrical heat generating layer is provided on a substrate as a heating element, comprising:

applying on the substrate a flowable base material to form a first electrically conductive layer, the flowable base material having carbon nanotubes dispersed therein, then applying on the first electrically conductive layer a protective layer, the first electrically conductive layer being in a state at the time of applying the protective layer that enables penetration of the protective layer through a surface of the first electrically conductive layer, wherein the first electrically conductive layer and/or the protective layer contacts with contact elements, and the first electrically conductive layer and the protective layer applied on the substrate are heated to compress the first electrically conductive layer and the protective layer, and wherein the protective layer includes a silicate thereby to form an inorganic layer.

2. Method according to claim 1, wherein the first electrically conductive layer and the protective layer applied on the substrate are heated to a temperature of 300° C. to 700° C.

3. The method according to claim 1, wherein the first electrically conductive layer is dried after application on the substrate, and the protective layer is subsequently applied.

4. The method according to claim 1, wherein each of the first electrically conductive layer and the protective layer are applied separately by a spraying process, by squeegee, or a printing process.

5. The method according to claim 1, wherein the first electrically conductive layer is applied onto the substrate as a uniform and continuous layer or in strips, the protective layer is subsequently applied onto the first electrically conductive layer as a uniform and continuous layer to cover the substrate, and before or after the application of the first electrically conductive layer or protective layer, strip-shaped contact elements are applied on the substrate.

6. The method according to claim 1, wherein before an application of the first electrically conductive layer in a heating region, an electrically insulating layer is applied onto the substrate.

7. The method according to claim 1, wherein for producing the first electrically conductive layer, as a non-electrically conductive, flowable base material, an aqueous solution is used.

8. The method according to claim 7, wherein carbon nanotubes and/or graphite are dispersed as an electrically conductive, flowable material into the base material, of the first electrically conductive layer.

9. The method according to claim 1, wherein a filler is dispersed into the protective layer.

10. The method according to claim 1, wherein an adhesive agent is dispersed into the first electrically conductive layer.

11. A method according to claim 1, wherein the contact elements are strip-shaped.

12. A method according to claim 1, wherein the compressing of the first electrically conductive layer and the protective layer by heating includes sintering the first electrically conductive layer and/or the protective layer, wherein the sintering of the first electrically conductive layer causes the carbon nanotubes dispersed therein to increase their contact with each other resulting in increased electrical conductivity of the first electrically conductive layer.

13. A method for producing a heating installation in which an electrical heat generating layer is provided on a substrate as a heating element, comprising:

applying on the substrate a flowable base material to form a first electrically conductive layer, the flowable base material having carbon nanotubes dispersed therein, applying on the first electrically conductive layer a protective layer such that the protective layer penetrates into the first electrically conductive layer, and compressing the first electrically conductive layer and the protective layer by temperature-treatment, wherein the protective layer includes a silicate thereby to form an inorganic layer, and wherein the first electrically conductive layer applied on the substrate is only heated by applying a voltage to the contact elements to effect the compressing of the first electrically conductive layer.

* * * * *